US011702255B2

(12) United States Patent
Reilink et al.

(10) Patent No.: US 11,702,255 B2
(45) Date of Patent: Jul. 18, 2023

(54) FLUID CONTAINER CAP WITH DUAL-POSITION RESTRICTOR

(71) Applicant: DIVERSEY, INC., Fort Mill, SC (US)

(72) Inventors: Derk Reilink, Bosch en Duin (NL); David Hall, Milwaukee, WI (US); Gregory R. Alcott, Utecht (NL); Nathan French, Union Grove, WI (US); Paul Larson, Franksville, WI (US)

(73) Assignee: Diversey, Inc., Fort Mill, SC (US)

( * ) Notice: Subject to any disclaimer, the term of this patent is extended or adjusted under 35 U.S.C. 154(b) by 0 days.

(21) Appl. No.: 17/724,706

(22) Filed: Apr. 20, 2022

(65) Prior Publication Data

US 2022/0332475 A1 Oct. 20, 2022

Related U.S. Application Data

(60) Provisional application No. 63/177,212, filed on Apr. 20, 2021.

(51) Int. Cl.

| | |
|---|---|
| ***B65D 47/06*** | (2006.01) |
| ***B65D 47/20*** | (2006.01) |
| ***B65D 83/24*** | (2006.01) |
| ***B65D 83/14*** | (2006.01) |
| ***B65D 83/48*** | (2006.01) |

(52) U.S. Cl.

CPC ..... *B65D 47/068* (2013.01); *B65D 47/20* (2013.01); *B65D 83/24* (2013.01); *B65D 83/48* (2013.01); *B65D 83/756* (2013.01)

(58) Field of Classification Search

CPC ..... B65D 47/068; B65D 47/20; B65D 83/24; B65D 83/48; B65D 83/756

See application file for complete search history.

(56) References Cited

U.S. PATENT DOCUMENTS

| | | | | |
|---|---|---|---|---|
| 4,200,119 | A | 4/1980 | Cunningham | |
| 4,852,773 | A | 8/1989 | Standlick et al. | |
| 5,816,453 | A * | 10/1998 | Spencer | B05B 11/007 222/321.3 |
| 5,954,240 | A | 9/1999 | Ducho et al. | |
| 5,996,848 | A | 12/1999 | Sperry et al. | |
| 6,598,630 | B1 | 7/2003 | Trippi, Jr. | |
| 7,201,292 | B2 | 4/2007 | Crossdale et al. | |
| 7,441,570 | B2 | 10/2008 | Hagleitner | |
| 7,575,633 | B2 | 8/2009 | Romanin | |
| 7,658,213 | B1 | 2/2010 | Anderson et al. | |
| 8,028,862 | B2 | 10/2011 | Rossignol | |
| 9,469,452 | B2 * | 10/2016 | Schultz, Jr. | B67D 7/0294 |
| 9,766,636 | B2 | 9/2017 | Jones et al. | |
| 10,376,917 | B2 | 8/2019 | Rospierski | |

(Continued)

FOREIGN PATENT DOCUMENTS

| | | |
|---|---|---|
| WO | 2010/048465 A1 | 4/2010 |
| WO | 2016/137940 A1 | 9/2016 |

*Primary Examiner* — Frederick C Nicolas

(74) *Attorney, Agent, or Firm* — Andrew R. Aranda; Chief IP Counsel

(57) ABSTRACT

A fluid container cap includes a connection structure, a dispensing connector, and a movable restrictor that adjusts flow through the container cap is disclosed. A fluid container cap includes a connection structure, a dispensing connector, a restrictor, and a valve that is movably adjustable to alter fluid flow through the container cap is also disclosed.

15 Claims, 13 Drawing Sheets

(56) References Cited

U.S. PATENT DOCUMENTS

| | | | | |
|---|---|---|---|---|
| 10,683,147 | B2 | 6/2020 | Choltco-Devlin et al. | |
| 10,815,117 | B1 | 10/2020 | Loreto | |
| 11,434,053 | B2 * | 9/2022 | Schuster | B65D 51/1616 |
| 2005/0095723 | A1 | 5/2005 | DiTrolio et al. | |
| 2014/0076938 | A1 | 3/2014 | Bonner et al. | |
| 2018/0215516 | A1 * | 8/2018 | Hershberger | B67D 7/005 |

* cited by examiner

FLUID CONTAINER CAP WITH DUAL-POSITION RESTRICTOR

This application claims the benefit of the filing date under 35 U.S.C. § 119(e) from United States Provisional Application for Patent Ser. No. 63/177,212, filed on Apr. 20, 2021.

BACKGROUND

Dilution and dispensing devices may often utilize plugs, threaded bottles, and threaded caps to open fluid connections within a cap and bottle assembly. Prior art designs typically include only a restricted flow path for the chemical at the bottom of a chemical pickup tube within a chemical reservoir. The restriction within the flow path is usually chosen to proportionally dispense chemicals at a fixed dilution rate in these prior art dispensing systems.

A further problem arises in that prior art restrictor connections in bottle systems are not compatible with positive displacement pump dilution systems under development. In some instances, new systems fail to adapt to prior art venturi education systems that are currently in use.

The present disclosure relates generally to fluid containers, and more particularly to a fluid container including a cap or connector that has a restricting orifice member or restrictor to control a flow rate of fluid from the fluid container.

SUMMARY

What is needed is a cap and/or connection assembly system and method that provides for both restricted (for venturi based education systems) and unrestricted (for positive displacement pumps or third party use) flow paths, while maintaining backwards compatibility to the existing dispensing apparatuses. Another benefit of this disclosure, is that the claimed embodiments allow bottles to be transferred back and forth between dispensing systems through the use of proprietary connectors for each flow path.

In a first aspect, the disclosure provides a fluid container cap including a connection structure. The connection structure includes an interior side and an exterior side configured to receive a dispenser cap for dispensing the fluid from the fluid container, portions of the connection structure defining a plug section and a bypass section, respectively. A bypassable restrictor is located in a flow path defined in the connection structure and defines a restriction orifice, wherein a portion of the bypassable restrictor is configured for non-returnable movement in a direction from the exterior side toward the interior side, from a first position in the plug section to a second position in the bypass section. In the first position of the bypassable restrictor, the dispensing of fluid through the connection structure is limited by the restriction orifice. In the second position of the bypassable restrictor, the dispensing of fluid through the connection structure is not limited by the restriction orifice, as fluid is configured to flow around the bypassable restrictor.

In a second aspect, the disclosure provides a method of attaching a dispensing connector to the connection structure of the fluid container cap, thereby moving the bypassable restrictor from the first position to the second position for unrestricted flow.

In another aspect, the disclosure provides a method of attaching a dispensing connector to the connection structure of the fluid container, thereby leaving the bypassable restrictor in the first position for restricted flow.

In another aspect, the disclosure provides a fluid container cap including a connection structure. The connection structure includes an interior side and an exterior side configured to receive a dispenser cap for dispensing the fluid from the fluid container, portions of the connection structure defining a plug section and a valve section comprising a movable valve, respectively. A restrictor is located in a flow path defined in the connection structure and defines a restriction orifice, wherein a portion of the restrictor is configured for adjustable movement in a direction from the exterior side toward the interior side from a first position in the plug section to a second restricted position in the valve section and to a third unrestricted position in the valve section. In the first position of the restrictor, dispensing of fluid through the connection structure is prohibited. In the second position of the restrictor, dispensing of fluid through the connection structure is limited by the restriction orifice. In the third position of the restrictor, dispensing of fluid through the connection structure is through the restriction orifice, around the restrictor, and through at least one unrestricted bypass channel.

In another aspect, the disclosure provides a method of attaching a dispensing connector to the connection structure of the fluid container cap, thereby moving the restrictor within a valve from the first position to the second position for restricted flow.

In another aspect, the disclosure provides a method of attaching a dispensing connector to the connection structure of the fluid container, thereby leaving the restrictor in a valve in the first position for no flow.

In another aspect, the disclosure provides a method of attaching a dispensing connector to the connection structure of the fluid container cap, thereby moving the restrictor within a valve from the second position to the third position for unrestricted flow.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure. Embodiments of the subject matter are disclosed with reference to the accompanying drawings and are for illustrative purposes only. The subject matter is not limited in its application to the details of construction or the arrangement of the components illustrated in the drawings.

DETAILED DESCRIPTION

Figures 1, 2:
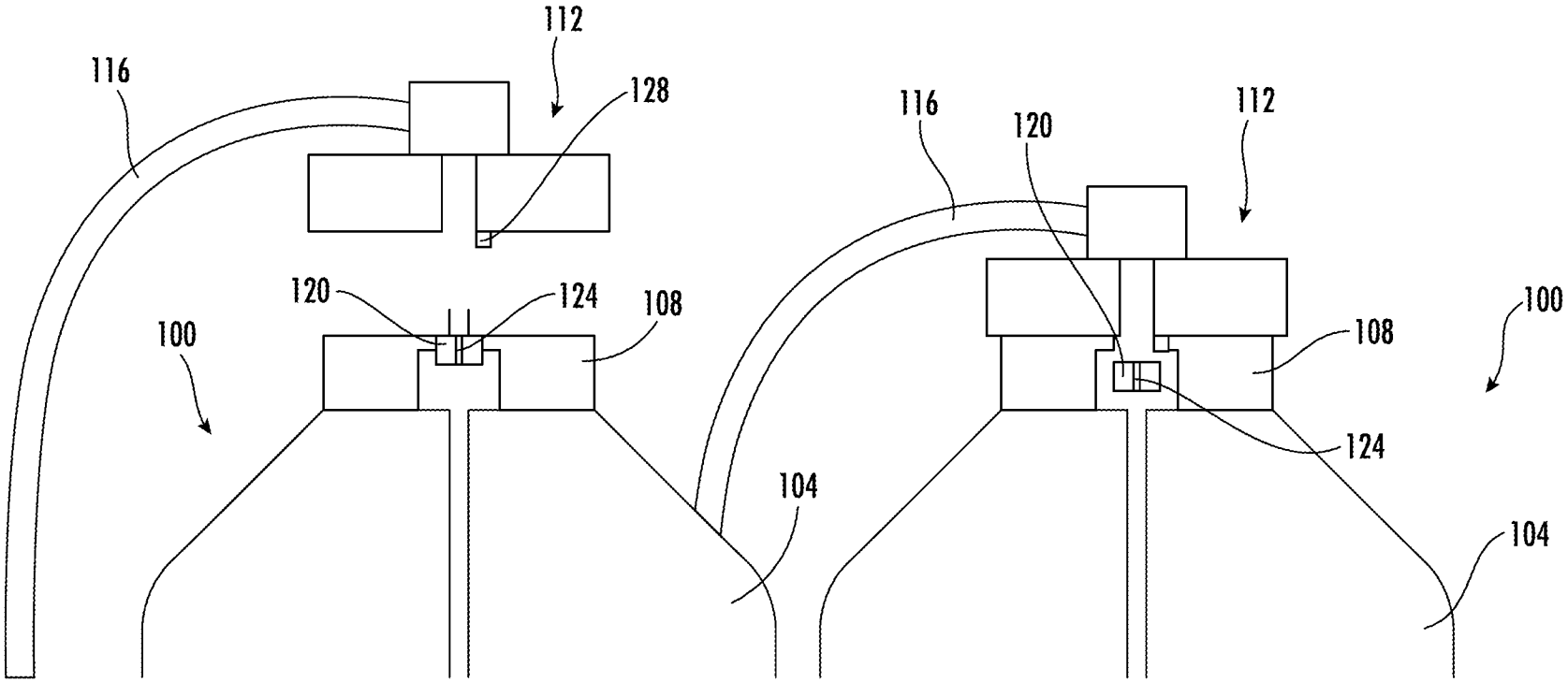
FIG. 1 is a schematic view of a fluid container and a dispensing connector prior to connection with the fluid container. A restrictor in the fluid container cap is in a first position.
FIG. 2 is a schematic view of the dispensing connector and the fluid container of FIG. 1 connected together. The restrictor in the fluid container cap is moved to a second position.

FIG. 1 shows a fluid package or container 100 including a body 104 that is configured to hold a quantity of fluid. The body 104 can have a rigid, flexible, or semi-rigid wall construction in various embodiments. The fluid contained by the fluid container 100 can be any number of useful fluids (e.g., cleaning chemicals, comestible liquids, cleaning solutions, cleaning products, disinfectants, detergents, soaps, surfactants, etc.). In addition to the body 104, the fluid container 100 includes a container cap 108 that closes the container 100 and provides a connection structure. The container cap 108 can be threaded or otherwise configured to mate with a dispensing connector 112, through which fluid from the fluid container 100 is configured to flow for dispensing fluid from within the fluid container 100. In certain embodiments, mating systems such as the Diversey® J-Fill® dispensing system may be employed. The dispensing connector 112 can be a discrete component or an integral part of a dispenser apparatus. The dispensing connector 112 can mate with the connection structure provided by the container cap 108 (FIG. 2) and may form a sealed connection therebetween. The dispensing connector 112 can be configured to mate with the container cap 108 either on its own or with the aid of one or more separate elements such as a seal, a clamp, and/or a fastener. The illustrated dispensing connector 112 is shown with an attached hose 116 for directing fluid dispensed from the fluid container 100 to a remote location. In some constructions, the dispensing connector 112 may be used without a hose.

To facilitate fluid dispensing from the fluid container 100, the dispensing connector 112 includes a fluid flow path extending therethrough, between interior and exterior (bottom and top in FIGS. 1-2, respectively) sides thereof. Likewise, the container cap 108 of the fluid container 100 includes a fluid flow path extending therethrough, between interior and exterior sides (bottom and top in FIGS. 1-2, respectively) thereof. The fluid flow path of the container cap 108 includes a flow restriction member or restrictor 120 that is configured in at least one position to limit a flow rate of fluid being dispensed from the fluid container 100. For example, the restrictor 120 has a restriction orifice 124 with a cross-sectional area that is substantially less than cross-sectional areas of other portions of flow paths through the container cap 108 and the dispensing connector 112 (e.g., at least a 50 percent smaller cross-sectional area, at least a 70 percent smaller cross-sectional area, at least a 80 percent smaller cross-sectional area, etc.). More generally, the restriction orifice 124 is sized based on the desired flow of fluid through the container cap 108. The restriction orifice 124 extends between interior and exterior ends of the restrictor 120, which may be formed as a monolithic element (e.g., molded plastic, rubber, polymeric materials, ceramics, metals, etc.). Seal rings, sleeves, springs, and straws may also comprise monolithic elements. In some constructions, multiple restriction orifices 124 are formed through the restrictor 120.

Figure 3:
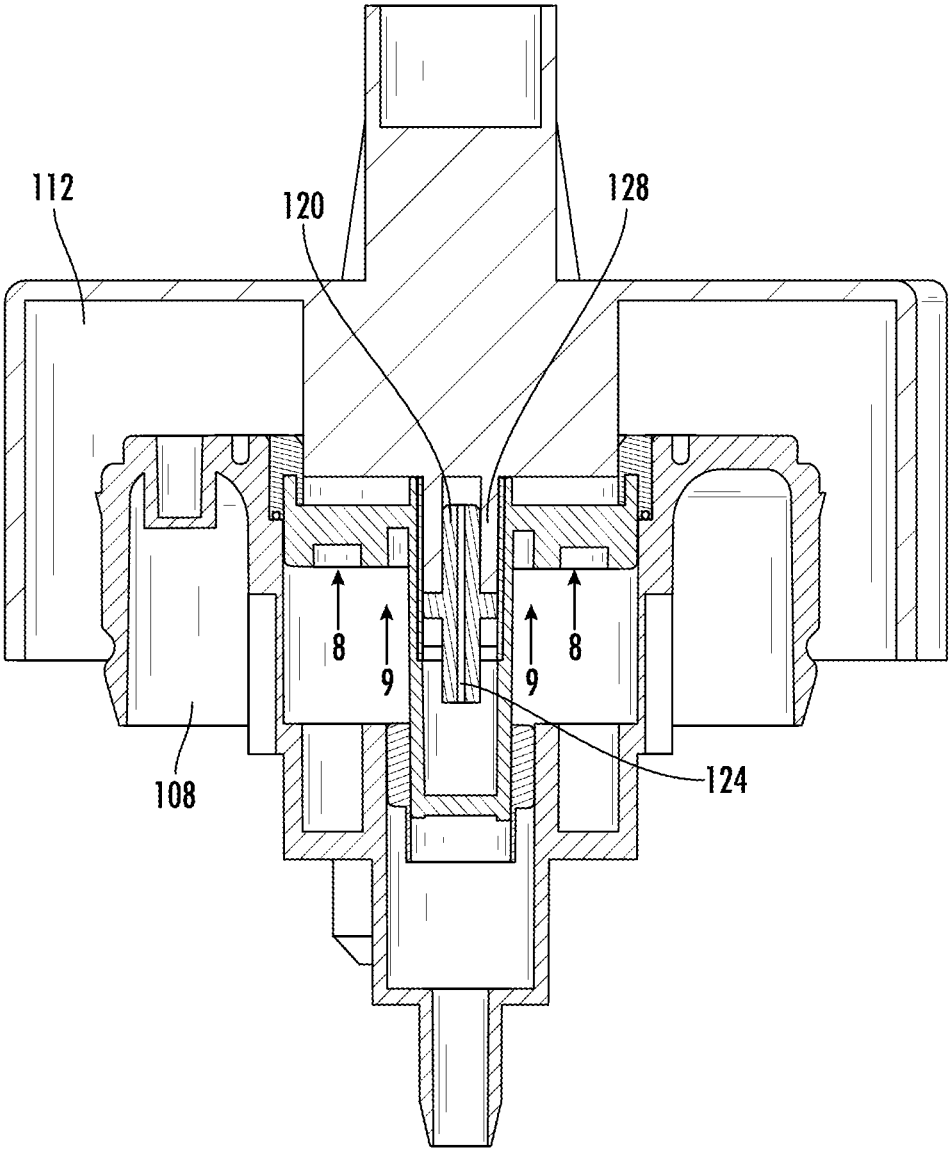
FIG. 3 is a cross-section view through the dispensing connector and the fluid container cap in the connected state of FIG. 2.

To facilitate use of the container cap 108 with multiple applications having different fluid flow rate requirements, the restrictor 120 is movable from a first or nominal position (FIG. 1) to a second position (FIGS. 2-3). In the first position, which may be a factory or default position on manufacture and/or delivery of the fluid container 100, the only fluid flow pathway for fluid to exit the fluid container 100 through the container cap 108 includes passage through the restrictor 120 (e.g., through the restriction orifice(s) 124). In the second position of the restrictor 120, the restriction orifice(s) 124 are still available, and there is additionally at least one bypass flow path around the restrictor 120. That is, flow through the container cap 108 is no longer limited to flowing through restrictor 120 when the restrictor is moved to the second position. Thus, the second position of the restrictor 120 enables a higher potential flow rate than the first position, given similar parameters, such as a particular fluid at a particular pressure differential.

Figure 4:
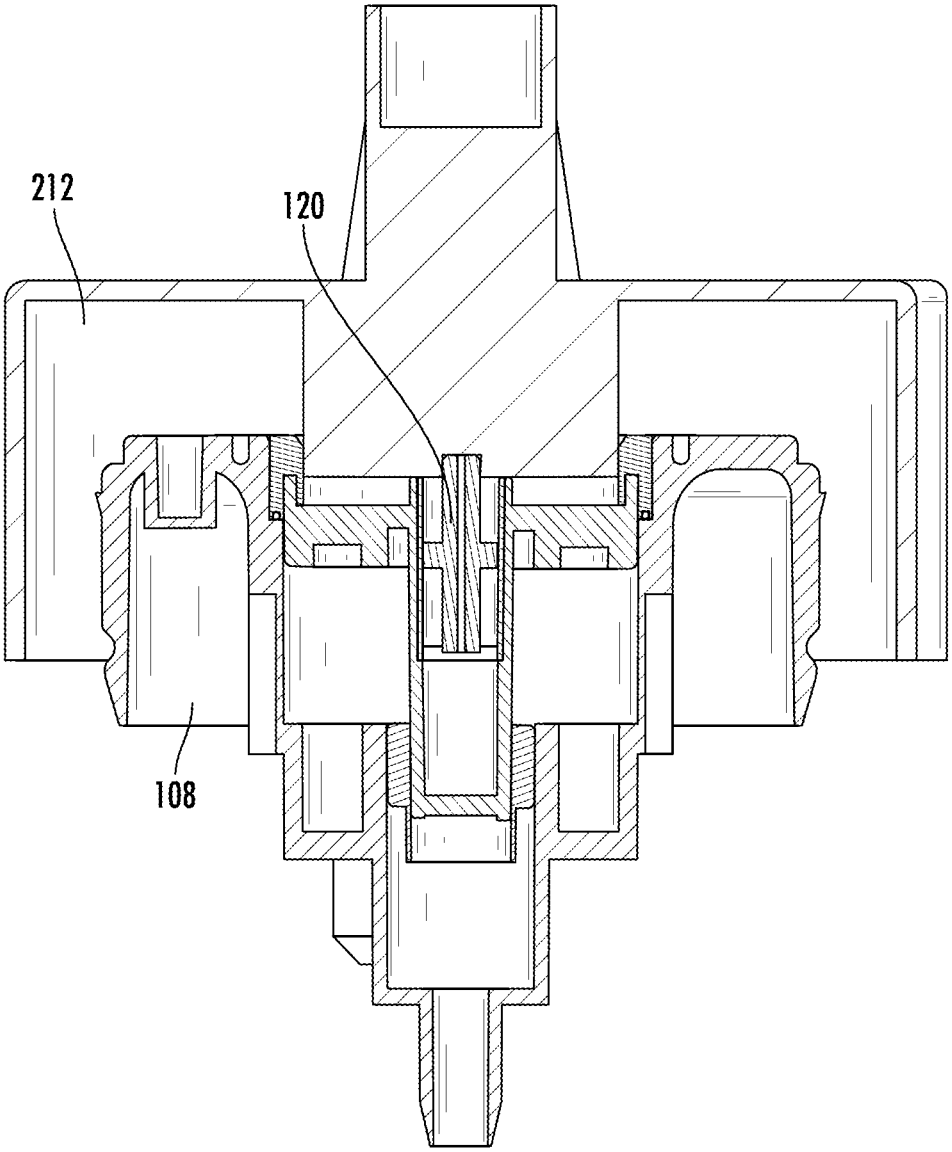
FIG. 4 is a cross-section view similar to FIG. 3 and illustrating another dispensing connector connected with the fluid container cap. The restrictor in the fluid container cap remains in a first or nominal position as in FIG. 1.

As shown in FIGS. 1 and 2, the dispensing connector 112 can include an actuator structure 128 (e.g., prong(s)) that can engage the restrictor 120 and move the restrictor 120 from the first position to the second position automatically when the dispensing connector 112 is coupled to the container cap 108. FIG. 4 illustrates the container cap 108 and the restrictor 120 with a different or second dispenser connector 212. As shown, the second dispenser connector 212 does not actuate the restrictor 120 to the second position. Instead, the dispenser connector 212 leaves the restrictor 120 in the first position for setting a higher flow restriction (relative to the position of the restrictor 120 shown in FIG. 3). As can be seen in FIG. 4, the dispenser connector 212 has no actuator structure for engaging the restrictor 120.

Figure 5:
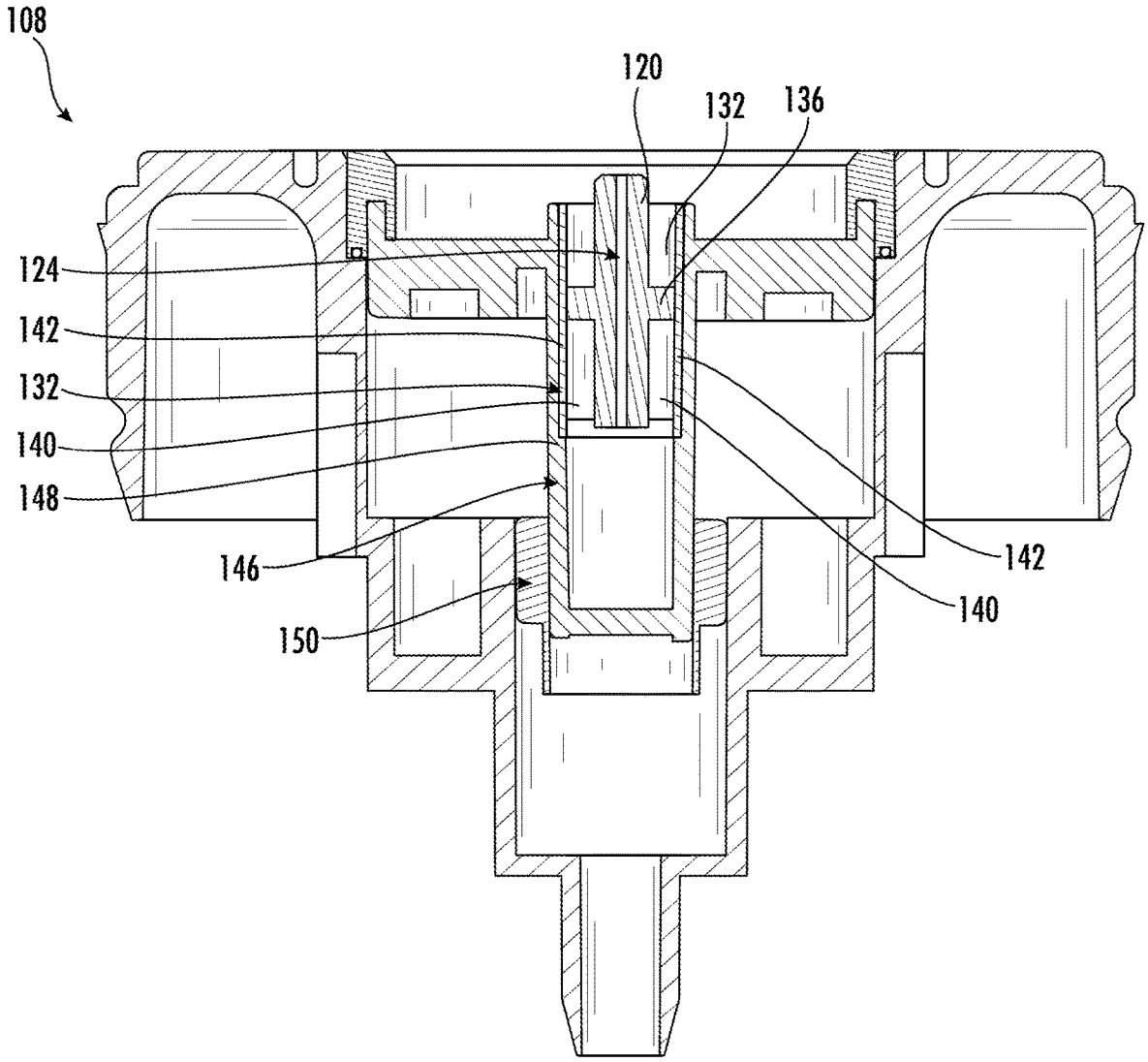
FIG. 5 is a cross-section view of the fluid container cap with the restrictor in the nominal position of FIG. 4.
Figure 6:
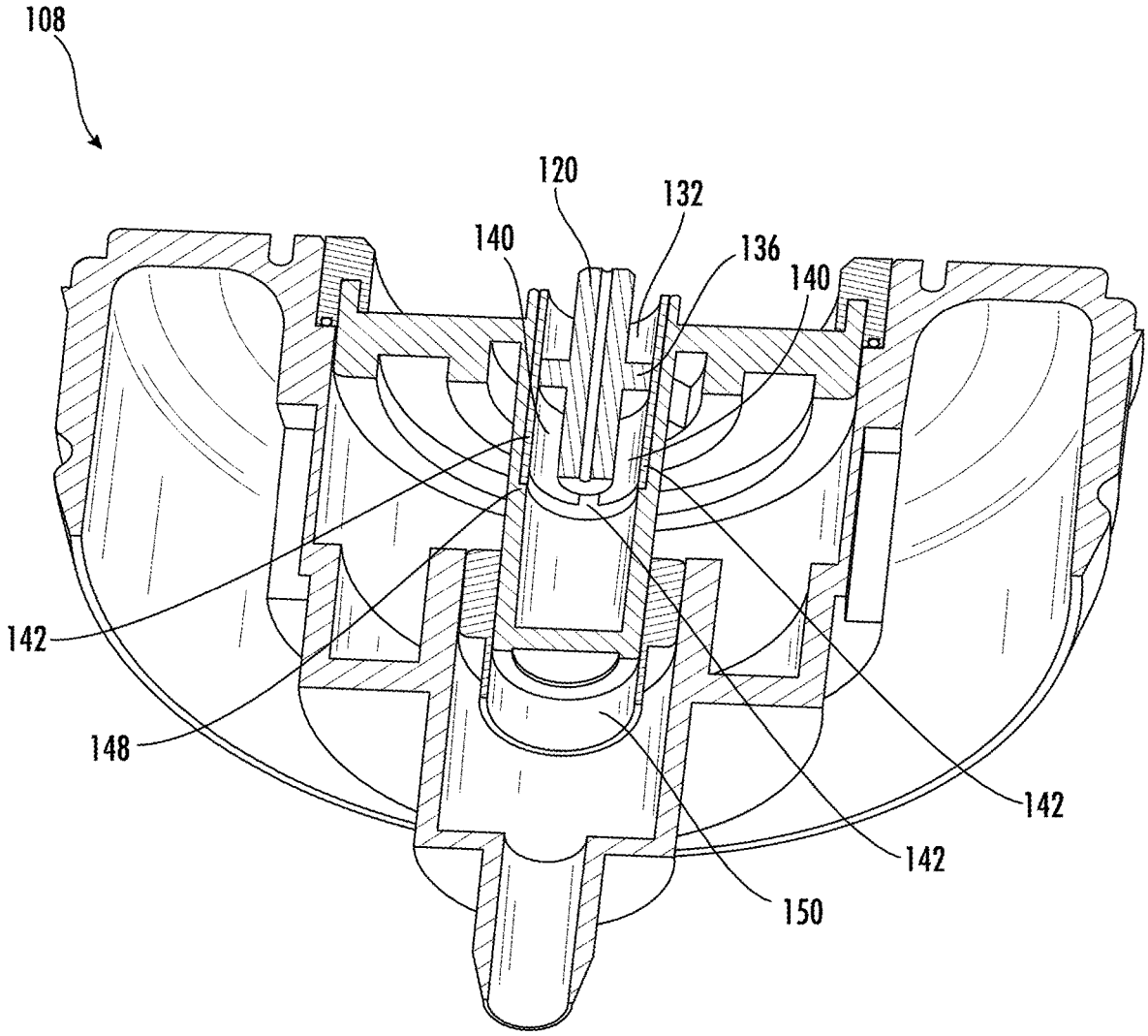
FIG. 6 is a perspective cross-section view of the fluid container cap with the restrictor in the nominal position consistent with FIGS. 4 and 5.

FIGS. 5 and 6 illustrate the container cap 108 with the restrictor 120 in the first position. The restrictor 120 may have a tip that, in the first position of the restrictor 120, extends or protrudes to the exterior from the portion of the container cap 108 in which it is received. In some constructions, the restrictor 120 can be flush or inset in the first position. As shown, the restrictor 120 is received in a central portion of the container cap 108 and extends along a central axis thereof. More particularly, the restrictor 120 is received within and movable relative to a sleeve 132 of the container cap 108. The illustrated sleeve 132 is annular (open on the interior) and defines an inner surface (e.g., cylindrical) that contacts a guide portion 136 of the restrictor 120. The guide portion 136 can be formed as a portion of increased cross-section of the restrictor 120 at a position spaced away from the interior and exterior ends (e.g., at or adjacent the center of the restrictor length). The guide portion 136 can plug the opening in the sleeve 132 when the restrictor 120 is in the first position. In particular, the guide portion 136 of the restrictor 120 establishes continuous circumferential surface contact with the inner surface of the sleeve 132 within a plug section of the sleeve 132 that is circumferentially continuous and conducive to plugging.

Figure 7:
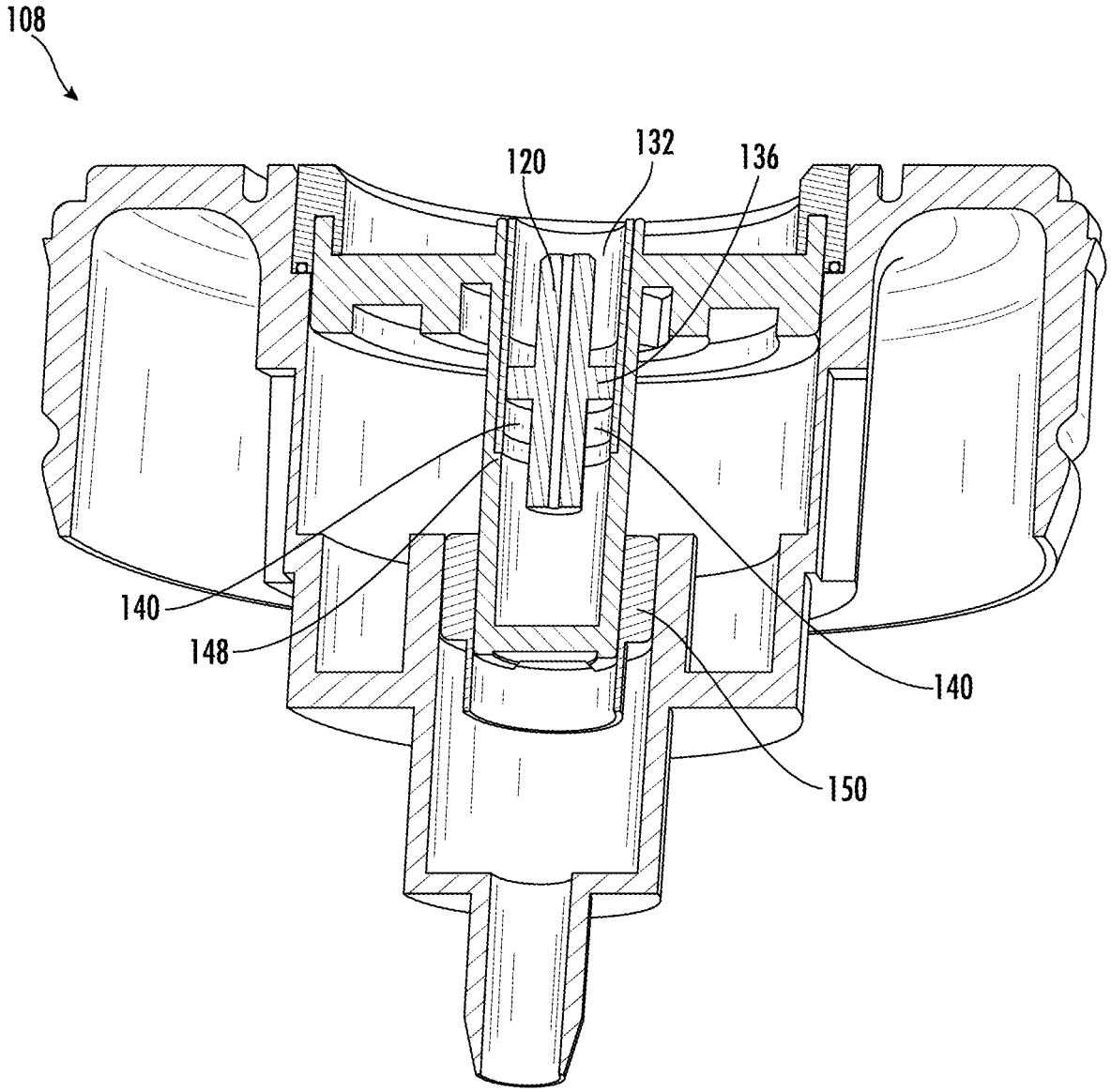
FIG. 7 is a cross-section view of the fluid container cap with the restrictor in the second position consistent with FIGS. 2 and 3.
Figure 8:
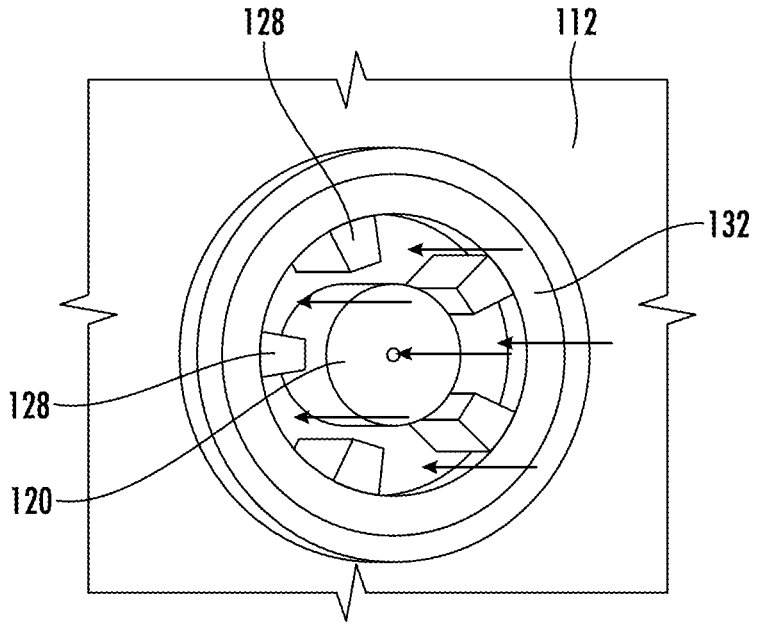
FIG. 8 is a cross-section view taken along line 8-8 in FIG. 3.

The sleeve 132 can also include a bypass or bypass section that is disposed toward the interior side of the container cap 108 and generally surrounding the restrictor 120. The bypass section is circumferentially discontinuous and features one or more flow apertures or windows 140 separated by respective ribs 142. FIG. 7 illustrates the restrictor 120 in the second position in which the guide portion 136 is disposed in the bypass section of the sleeve 132 having the windows 140. In particular, the guide portion 136 rests against the inside of the ribs 142. As such, fluid from inside the fluid container 100 can exit through the container cap 108 by flowing through the windows 140 (e.g., one or more axial flow paths defined by the sleeve exterior of the restrictor 120) and around the restrictor 120 in addition to flow through the orifice 124. As such, flow is not limited to flowing only through the restriction orifice 124. The guide portion 136 (e.g., a shoulder surface thereof adjacent to the surface contacting the sleeve 132) can provide the engagement portion for engagement by the prong(s) 128 of the first dispensing connector 112. The restrictor 120 is configured to move only in one direction, from the first position to the second position, without the restrictor 120 being able to return to the first position. That is, there is no biasing mechanism (provided in the container cap 108 or the dispensing connector 112) to return or bias the restrictor 120 back to the first position when the dispensing connector 112 is removed.

The fluid container 100 can be filled and delivered by the manufacturer with the restrictor 120 in the first or flow-restricted position. Connection of the dispenser connector 212 (or any dispenser connector not having the prongs 128 or similar actuator structure) with the container cap 108 leaves the restrictor 120 in the original or first position for flow-restricted use. When the dispensing connector 112 is connected to the container cap 108, the dispensing connector 112 automatically moves the restrictor 120 to the second position for high-flow or unrestricted flow, of fluid from the container 100. During unrestricted flow use, the restrictor 120 need not be removed from the container cap 108—it is simply displaced within the container cap 108. In some constructions, the dispensing connector 112 of FIGS. 1-3 can be configured for use with a positive displacement pump that operates to meter the fluid from the fluid container 100 and does not require the orifice metering of the restrictor 120. The dispensing connector 212 of FIG. 4 can be configured for a dispensing system that uses vacuum to draw the fluid from the fluid container 100 and relies on the restriction of the orifice 124 to meter flow.

Figure 9:
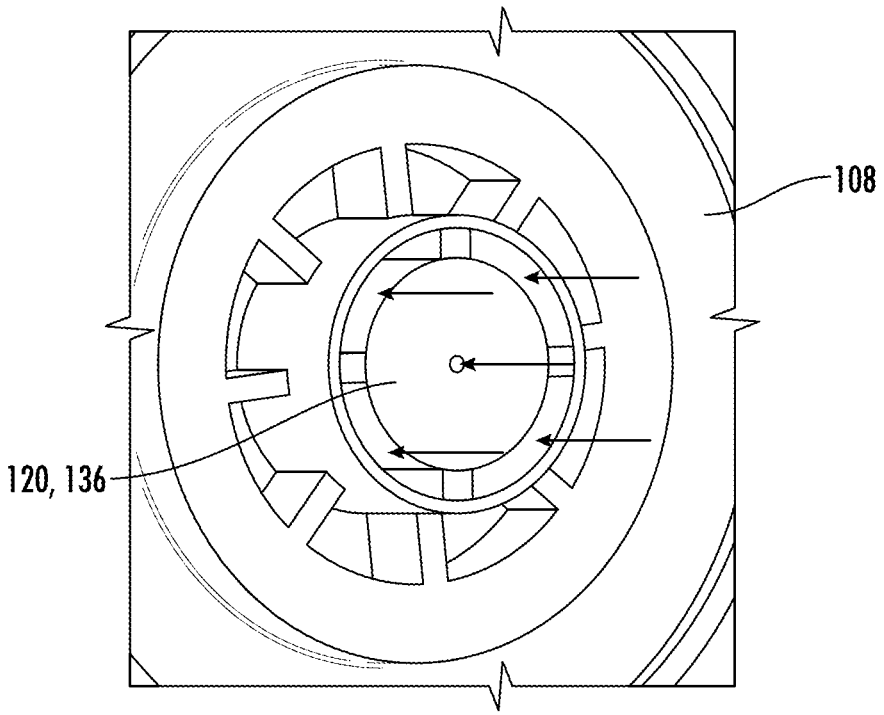
FIG. 9 is a cross-section view taken along line 9-9 in FIG. 3.
Figure 10:
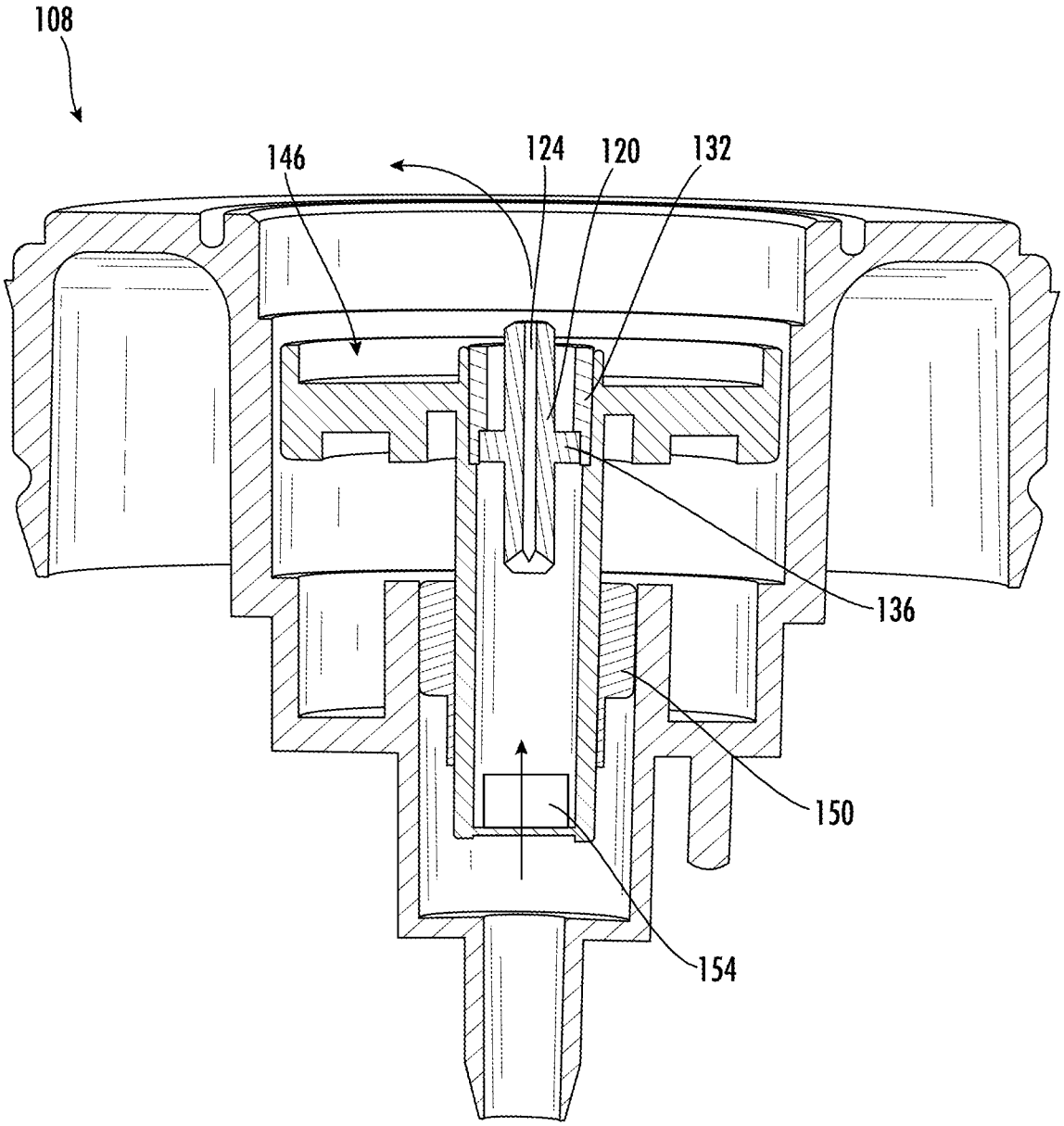
FIG. 10 is a cross-section view of the fluid container cap showing a valve in an open position.

In some embodiments, and with reference to FIG. 5, the container cap 108 can further includes a valve 146. The valve 146 can operate to open and close the flow path through the container cap 108, or otherwise control the flow of fluid in a passive or active control scheme. FIGS. 3-7 illustrate the valve 146 in a closed position within the container cap 108. The movable restrictor 120 is positioned within the movable valve 146. The valve 146 can be mechanically or electrically actuated. The sleeve 132 in which the restrictor 120 resides can be pressed into a wall of the valve 146. A shoulder 148 in this wall can form a stop that sets the axial position of the sleeve 132 when the sleeve 132 is pressed into the container cap 108. Accurate axial positioning of the sleeve 132 guarantees that the dispensing connector 112 moves the restrictor 120 to the proper position in the bypass section of the sleeve 132 to put the restrictor guide portion 136 in alignment with the windows 140 (e.g., a central location along the windows 140). The cap 108 supports a seal 150 that surrounds the valve 146 and that inhibits flow when the valve is in the closed position. In some constructions, the valve 146 is varied from a closed position to an open position by attachment of the dispensing connector 112, 212 to the container cap 108, or by another mechanism. With regard to the dispensing connector 112, the force to move the restrictor 120 from the first position to the second position can be less than the force to open the valve 146 so that the restrictor 120 is displaced to the second position before the valve 146 opens. The valve 146 is illustrated in the open position in FIG. 10, with the flow path through the valve 146 indicated by arrows. As shown, the restrictor 120 is in the first position such that flow of fluid through the valve 146 passes only through the restrictor orifice 124. The valve 146 also includes one or more flow apertures or windows 154 to establish fluid communication with the interior of the body 104 of the container 100 where the fluid is held. Consistent with FIGS. 7 and 9, the restrictor 120 is movable within the valve 146 to the second position to facilitate flow through the restrictor orifice 124 and around the restrictor 120.

According to certain embodiments, a fluid container cap comprising: a connection structure including an interior side and an exterior side configured to mate with a dispensing connector for dispensing the fluid from the fluid container, portions of the connection structure defining a plug section and a valve section comprising a movable valve; and a restrictor located in a flow path defined in the connection structure and defining a restriction orifice, wherein a portion of the restrictor is configured for adjustable movement in a direction from the exterior side toward the interior side from a first position in the plug section to a second restricted position in the valve section and to a third unrestricted position in the valve section, wherein in the first position of the restrictor, dispensing of fluid through the connection structure is prohibited, wherein in the second restricted position of the restrictor, dispensing of fluid through the connection structure is limited by the restriction orifice, and wherein in the third unrestricted position of the restrictor, dispensing of fluid through the connection structure is through the restriction orifice, around the restrictor, and through at least one unrestricted bypass channel is provided.

In certain embodiments, the valve may be movably adjusted or toggled between a first closed position, a second restricted flow position, and a third unrestricted flow position. The valve may operate to open, close, or adjust the flow path through the cap based on the valve position. Further, the valve comprises one or more flow apertures or windows establishing fluid communication through the cap.

Figure 11:
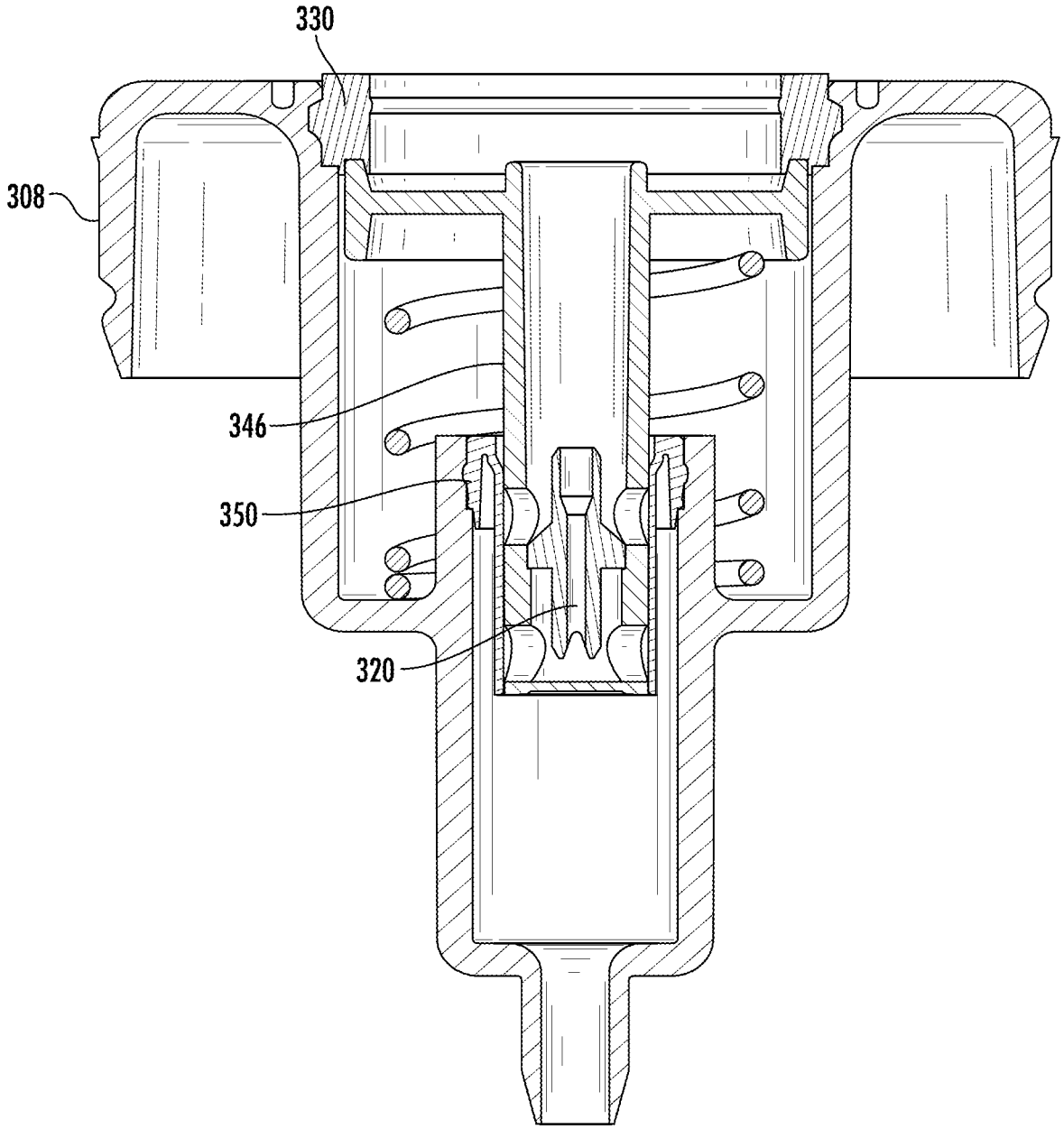
FIG. 11 is a cross-section view of the fluid container cap showing a valve and plug in a first, closed position.
Figure 12:
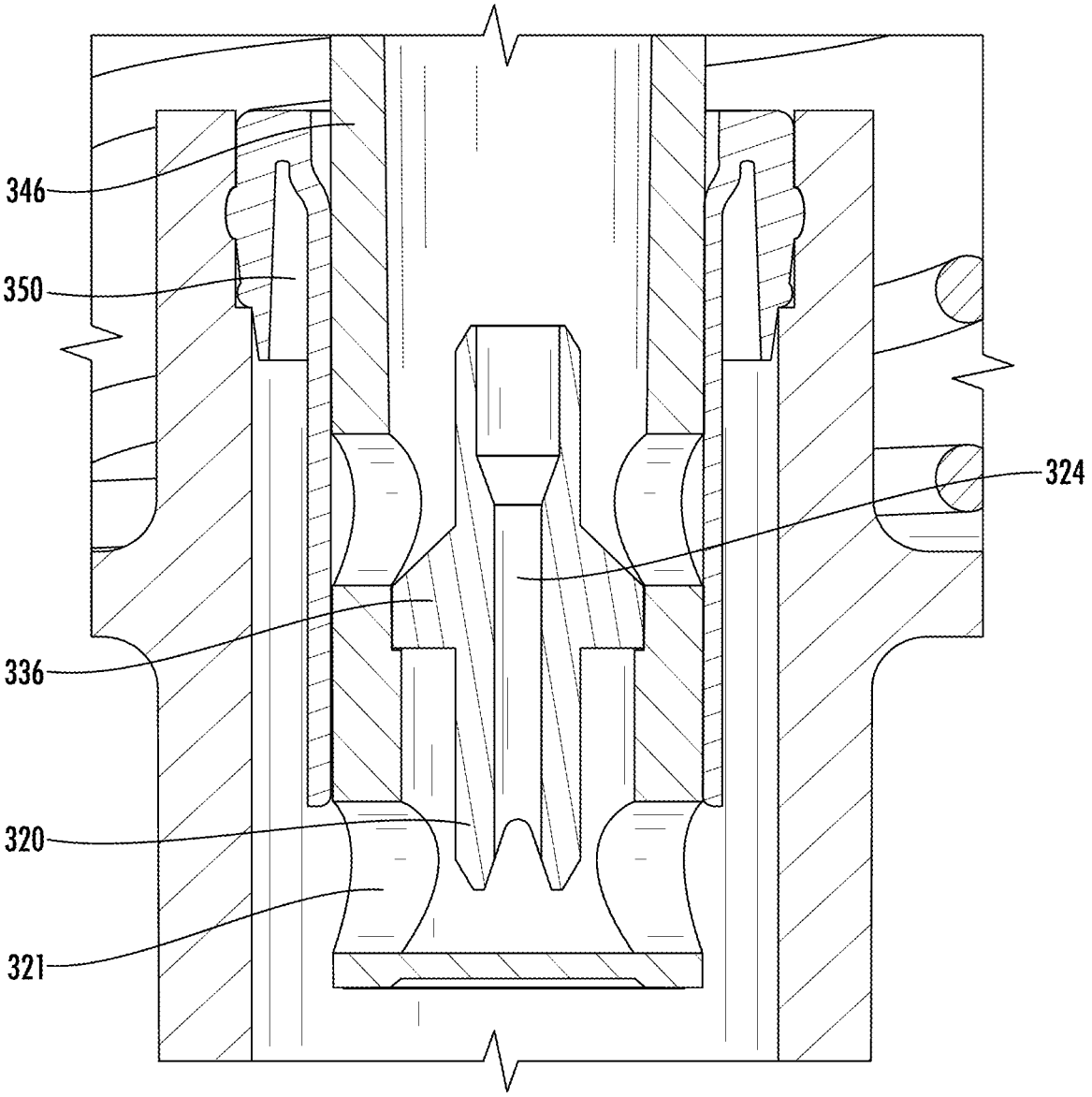
FIG. 12 is a cross-section view of the fluid container cap showing a valve and plug in a second, open, restricted flow position.

Turning to FIGS. 11 and 12, FIG. 11 illustrates the plug body 308 with the restrictor 320 in the first closed position. In certain embodiments, the plug body 308 comprises a retaining ring 330, which comprises a threaded connection. As shown, the restrictor 320 is received in a central portion of the plug body 308 and extends along a central axis thereof. More particularly, the restrictor 320 is received within a valve 346 and movable relative to a sleeve 350 of the plug body 308.

The illustrated sleeve 350 is annular (open on the interior) and defines an inner surface (e.g., cylindrical) within valve 346, that contacts a guide portion 336 of the restrictor 320. In certain embodiments, the sleeve is annular and defines an inner surface that contacts an outer surface of the valve. The guide portion 336 can be formed as a portion of increased cross-section of the restrictor 320 at a position spaced away from the interior and exterior ends (e.g., at or adjacent the center of the restrictor length). The guide portion 336 can plug the opening in the sleeve 350 and valve 346 when the restrictor 320 is in the first position. In certain embodiments, the guide portion 336 of the restrictor 320 may establish continuous circumferential surface contact with the inner surface of the valve 346 within a plug section of the sleeve 350 that is circumferentially continuous and conducive to plugging.

Figure 13:
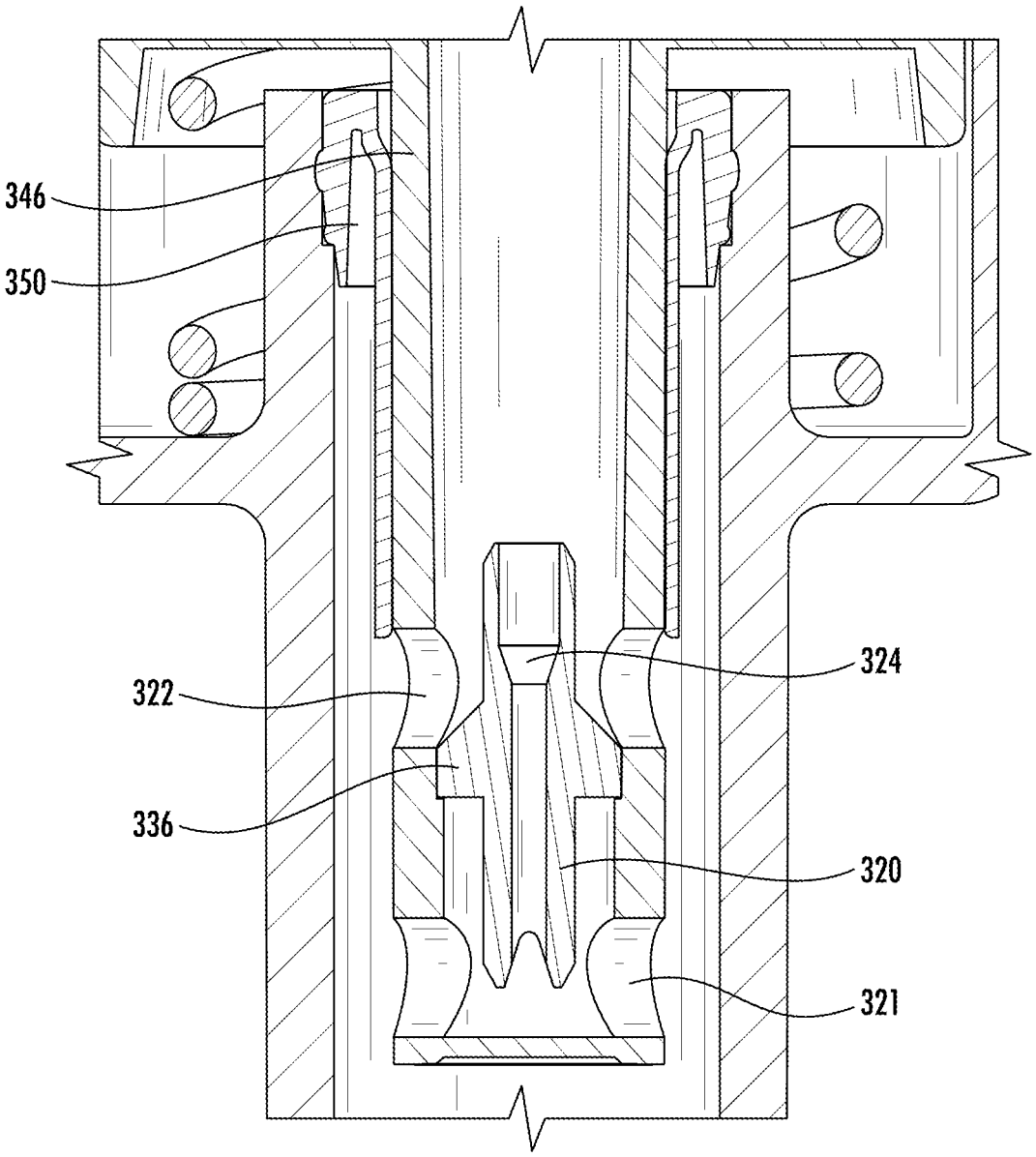
FIG. 13 is a cross-section view of the fluid container cap showing a valve and plug in a third, open, unrestricted flow position.

In certain embodiments, the valve is movably adjustable with relation to the sleeve providing no flow path, a restricted flow path, and an unrestricted flow path. The sleeve 350 can also include a closed position, restricted flow channel 321, and unrestricted flow channel 322 that is disposed toward the interior side of the plug body 308 and generally surrounding the restrictor 320. The valve 346 is movable within sleeve 350 and features one or more flow apertures or windows separated by continuous valve wall sections. FIG. 12 illustrates the restrictor 320 in the second position in which the valve 346 is disposed towards the interior side of plug body 308, and towards the interior of sleeve 350 exposing the restricted flow channel 321. FIG. 13 illustrates the restrictor 320 in the third position in which the valve 346 is disposed towards the interior side of plug body 308, and towards the interior of sleeve 350 exposing the restricted flow channel 321 and unrestricted flow channel 322.

From the restricted flow channel 321, fluid may flow through the restrictor 320 via restriction orifice 324. As such, fluid from inside a fluid container can exit through the plug body 308 by flowing through the restricted flow channel 321 (e.g., one or more axial flow paths defined by the valve exterior of the restrictor 320) and around the restrictor 320 in addition to flow through the orifice 324. Thus, flow is not limited to flowing only through the restriction orifice 324. The guide portion 336 (e.g., a shoulder surface thereof adjacent to the surface contacting the valve 346) can provide the engagement portion for engagement with the walls of the valve 346. The restrictor 320 and valve are configured to move in two directions, from the first position to the second position, from the second position to the third position, from the third position to the second position, and from the second position to the first position.

From the unrestricted flow channel 322, fluid may bypass and flow around the restrictor 320 entirely. As such, fluid from inside a fluid container can exit through the plug body 308 by flowing through the restricted flow channel 321 (e.g., one or more axial flow paths defined by the valve exterior of the restrictor 320) around the restrictor 320 in addition to flow through the orifice 324, and bypassing restrictor 320 through unrestricted flow channel 322. Thus, flow is not limited to flowing only through the restriction orifice 324.

Figure 14:
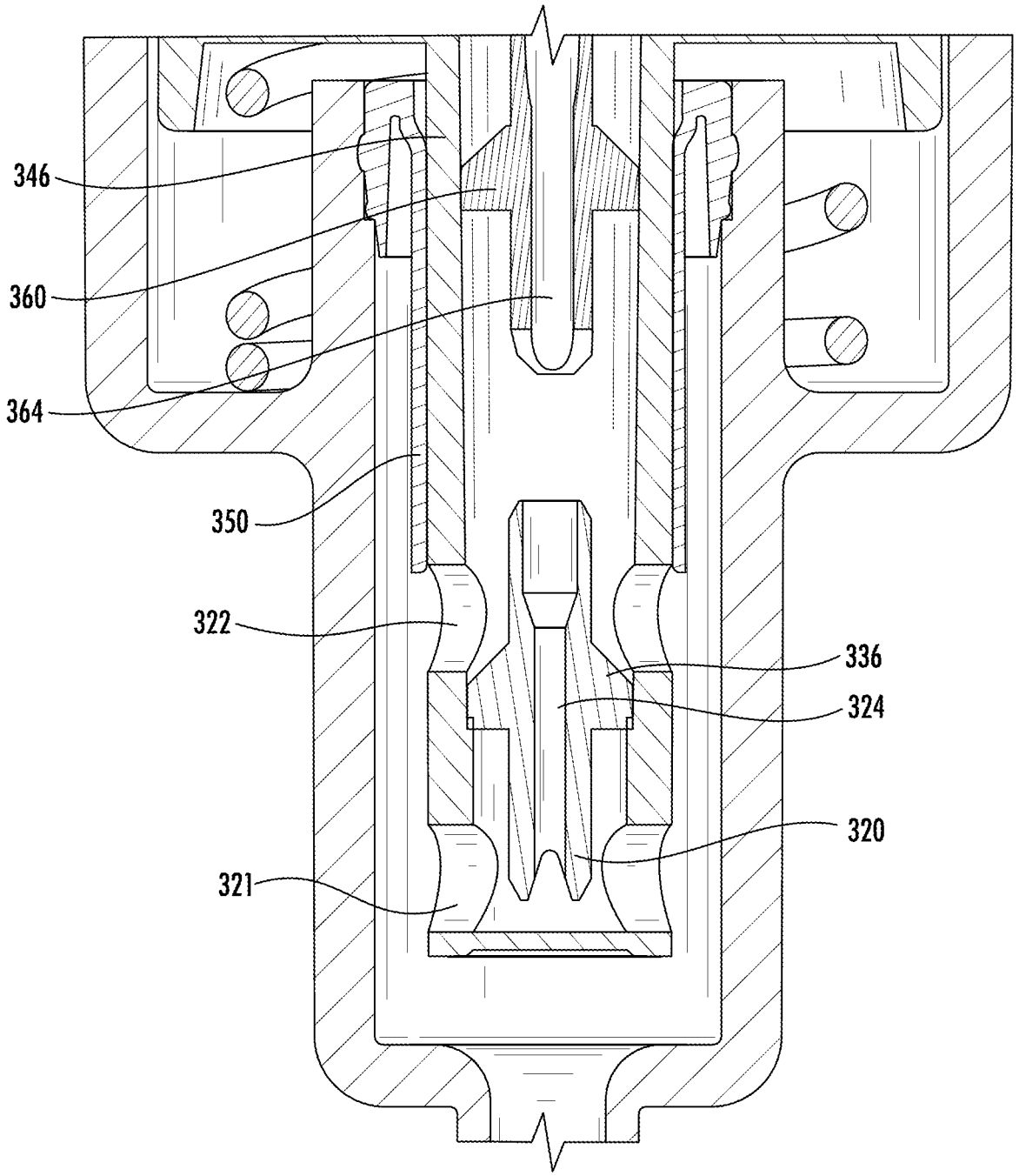
FIG. 14 is a cross-section view of the fluid container cap showing a valve and plug in a third, open, and unrestricted flow position with a second restrictor.

Turning to FIG. 14, shown is an embodiment illustrating the valve 346 in a third position, but including a second restrictor 360 with second restriction orifice 364. FIG. 14 illustrates the restrictor 320 in the third position in which the valve 346 is disposed towards the interior side of plug body 308, and towards the interior of sleeve 350 exposing the restricted flow channel 321 and unrestricted flow channel 322. However, unlike previous embodiments, the second restrictor 360 lies in the fluid flow path after the first restrictor 320. Fluid that reaches the second restrictor 360 may be limited in flow by the second restriction orifice 364, and how tightly the second restriction 360 fits within the inner surface of valve 346.

Figure 15:
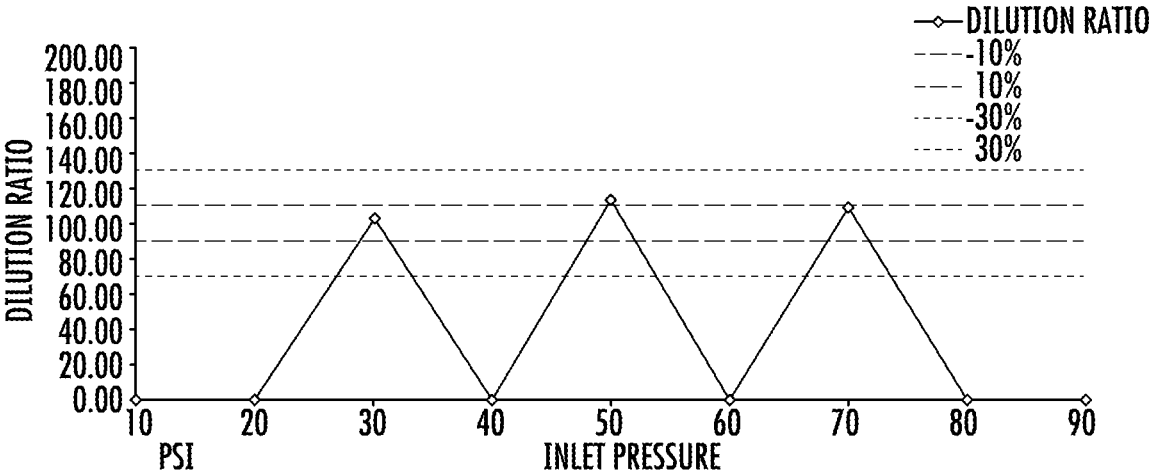
FIG. 15 is a scatter-plot showing the dilution ratio variance when the valve and plug are in a second, open, restricted flow position.
Figure 16:
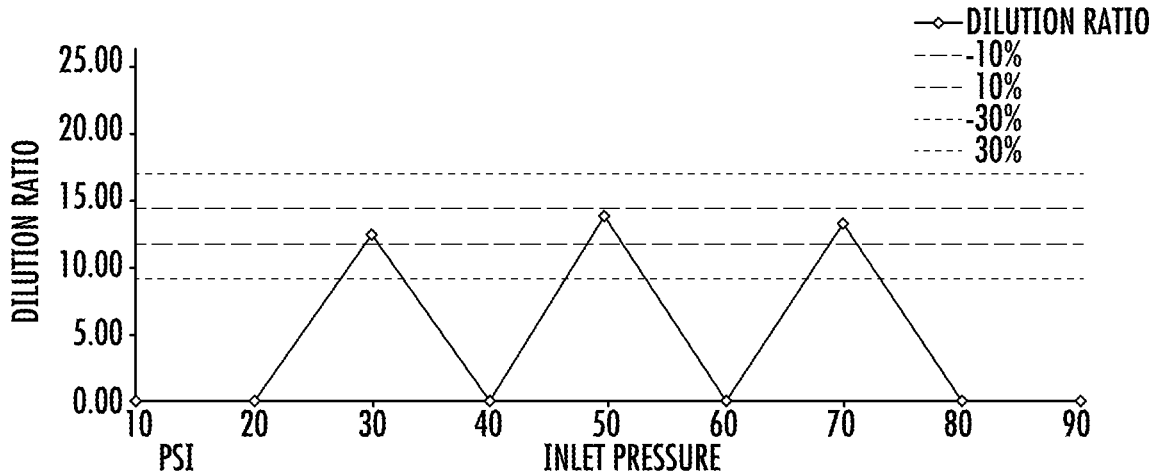
FIG. 16 is a scatter-plot showing the dilution ratio variance when the valve and plug are in a third, open, unrestricted flow position.

Turning to FIGS. 15 and 16, shown are scatter-plots demonstrating the dilution ratio tolerance with the adjustable valve positions and restrictor of the presently claimed embodiments. FIG. 15 shows a target dilution ratio of 100 at fluid inlet pressures of 30 psi, 50 psi, and 70 psi with the valve and restrictor in the second position for restricted flow. At all three pressures, the observed dilution ratio was maintained in a range of about +/−10% of the target dilution ratio of 100. Within +/−10% of the target dilution ratio is preferred by those dispensing various fluids and fluid mixtures. In maintaining a tolerance of about +/−10% of the target dilution ratio, the presently claimed embodiments demonstrate great control when compared to other prior art solutions.

FIG. 16 shows a target dilution ratio of 13 at fluid inlet pressures of 30 psi, 50 psi, and 70 psi with the valve and restrictor in the third position for unrestricted flow. At all three pressures, the observed dilution ratio was maintained within the range of +/−10% of the target dilution ratio of 13. At the higher, unrestricted flow rates of the fluid, the range +/−10% of the target dilution ratio is achieved by the presently claimed embodiments. Further, FIG. 16 demonstrates that the third position provides significantly more free fluid flow as can be seen by the dilution ratio being turned down from 100 to 13, and still maintaining a +/−10% tolerance.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

What is claimed is:

1. A fluid container cap comprising:

a connection structure including an interior side and an exterior side configured to mate with a dispensing connector for dispensing fluid from the fluid container, portions of the connection structure defining a plug section and a bypass section; and a restrictor located in a flow path defined in the connection structure and defining a restriction orifice, wherein a portion of the restrictor is configured for non-returnable movement in a direction from the exterior side toward the interior side from a first position in the plug section to a second position in the bypass section, wherein in the first position of the restrictor, dispensing of the fluid through the connection structure is limited by the restriction orifice, and wherein in the second position of the restrictor, dispensing of the fluid through the connection structure is through the restriction orifice and around the restrictor.

2. The cap of claim 1, wherein the connection structure and the dispensing connector are configured to mate with the aid of one or more separate elements comprising at least one of a seal, a clamp, a fastener, or combination thereof.

3. The cap of claim 1, wherein the restriction orifice comprises a cross-sectional area that is at least about 50% smaller than cross-sectional areas of other portions of flow paths through the connection structure and the dispensing connector.

4. The cap of claim 1, wherein the restrictor comprises a monolithic element.

5. The cap of claim 1, wherein the restrictor comprises at least one restriction orifice.

6. The cap of claim 1, wherein the dispensing connector comprises an actuator structure which engages the restrictor and moves the restrictor from the first position to the second position.

7. The cap of claim 1, wherein the connection structure further comprises a sleeve, wherein the sleeve is annular and defines an inner surface that contacts a guide portion of the restrictor.

8. The cap of claim 7, wherein the sleeve includes the bypass section that is disposed toward the interior side of the connection structure and surrounds the restrictor.

9. The cap of claim 8, wherein the bypass section is circumferentially discontinuous.

10. The cap of claim 8, wherein the bypass section comprises one or more flow apertures or windows separated by ribs.

11. A fluid container cap comprising:

a connection structure including an interior side and an exterior side configured to mate with a dispensing connector for dispensing fluid from the fluid container, portions of the connection structure defining a plug section and a valve section comprising a movable valve; and a restrictor located in a flow path defined in the connection structure and defining a restriction orifice, wherein a portion of the restrictor is configured for adjustable movement in a direction from the exterior side toward the interior side from a first position in the plug section to a second restricted position in the valve section and to a third unrestricted position in the valve section, wherein in the first position of the restrictor, dispensing of the fluid through the connection structure is prohibited, wherein in the second restricted position of the restrictor, dispensing of the fluid through the connection structure is limited by the restriction orifice, and wherein in the third unrestricted position of the restrictor, dispensing of the fluid through the connection structure is through the restriction orifice, around the restrictor, and through at least one unrestricted bypass channel.

12. The cap of claim 11, wherein the valve may operate to open, close, or adjust the flow path through the cap.

13. The cap of claim 11, wherein the valve comprises one or more flow apertures or windows establishing fluid communication.

14. The cap of claim 11, further comprising a sleeve, wherein the sleeve is annular and defines an inner surface that contacts an outer surface of the valve.

15. The cap of claim 14, wherein the valve is movably adjustable with relation to the sleeve providing no flow path, a restricted flow path, and an unrestricted flow path.

* * * * *